US007422520B2

(12) United States Patent
Coulton et al.

(10) Patent No.: US 7,422,520 B2
(45) Date of Patent: Sep. 9, 2008

(54) ROOF RIDGE VENT HAVING AN INTEGRAL COVERING AND METHOD OF INSTALLING A RIDGE VENT

(75) Inventors: Michael S. Coulton, North Wales, PA (US); George Caruso, Ambler, PA (US)

(73) Assignee: Benjamin Obdyke Incorporated, Horsham, PA (US)

( * ) Notice: Subject to any disclaimer, the term of this patent is extended or adjusted under 35 U.S.C. 154(b) by 54 days.

(21) Appl. No.: 11/305,623

(22) Filed: Dec. 16, 2005

(65) Prior Publication Data

US 2006/0154597 A1 Jul. 13, 2006

Related U.S. Application Data

(60) Provisional application No. 60/637,972, filed on Dec. 21, 2004.

(51) Int. Cl.
*F24F 7/02* (2006.01)

(52) U.S. Cl. ..... 454/365

(58) Field of Classification Search ..... 454/365
See application file for complete search history.

(56) References Cited

U.S. PATENT DOCUMENTS 4,942,699 A 7/1990 Spinelli ..... 52/57
5,425,672 A * 6/1995 Rotter ..... 454/365
5,605,018 A * 2/1997 McElderry et al. ..... 52/57
5,673,521 A 10/1997 Coulton et al. ..... 52/199
5,676,597 A 10/1997 Bettoli et al. ..... 454/365
5,813,176 A * 9/1998 Tzeng et al. ..... 52/198
5,902,432 A 5/1999 Coulton et al. ..... 156/199
5,960,595 A 10/1999 McCorsley, III et al. ..... 52/199
6,125,602 A 10/2000 Freiborg et al. ..... 52/560
6,298,613 B1 10/2001 Coulton et al. ..... 52/199
6,308,472 B1 10/2001 Coulton et al. ..... 52/198
6,418,692 B1 7/2002 Freshwater et al. ..... 52/553
6,530,189 B2 3/2003 Freshwater et al. ..... 52/553
2002/0193065 A1* 12/2002 Morris et al. ..... 454/365

* cited by examiner

*Primary Examiner*—Steve McAllister
*Assistant Examiner*—Helena Kosanovic
(74) *Attorney, Agent, or Firm*—Howson & Howson LLP

(57) ABSTRACT

A roof ridge vent having a ventilation component integrally secured to a waterproof outer covering. During installation of the vent, both the ventilation component and outer covering are simultaneously installed in a single process step. The use and separate installation of cap shingles or the like over a pre-installed vent is eliminated. The vent and covering are provided in an elongate, continuous length in a spiral roll and are installed as a single continuous length on a roof ridge overlying an elongate open ventilation slot.

17 Claims, 3 Drawing Sheets

FIG.1
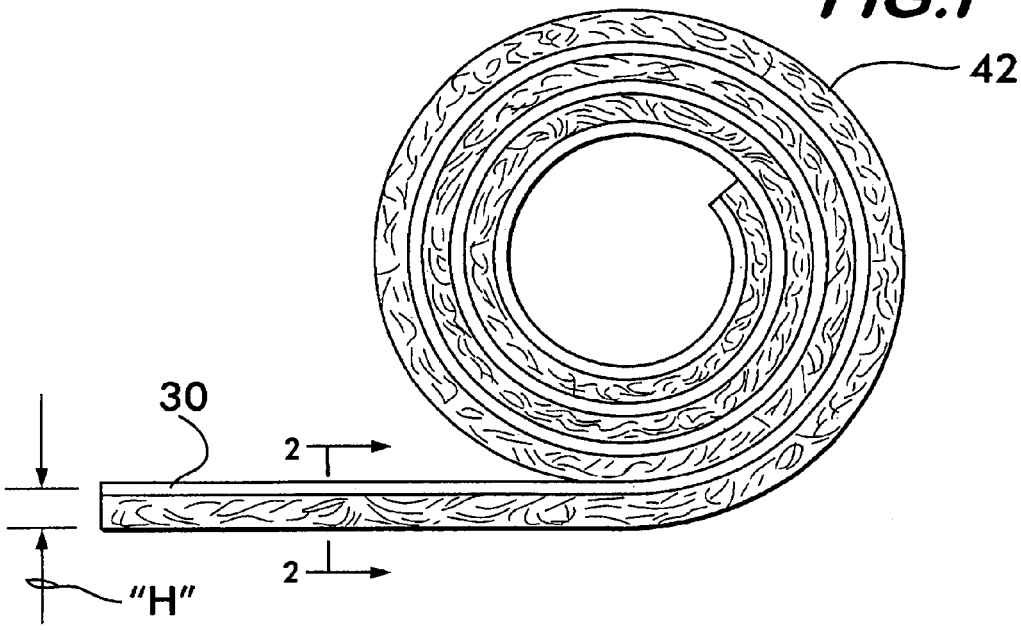
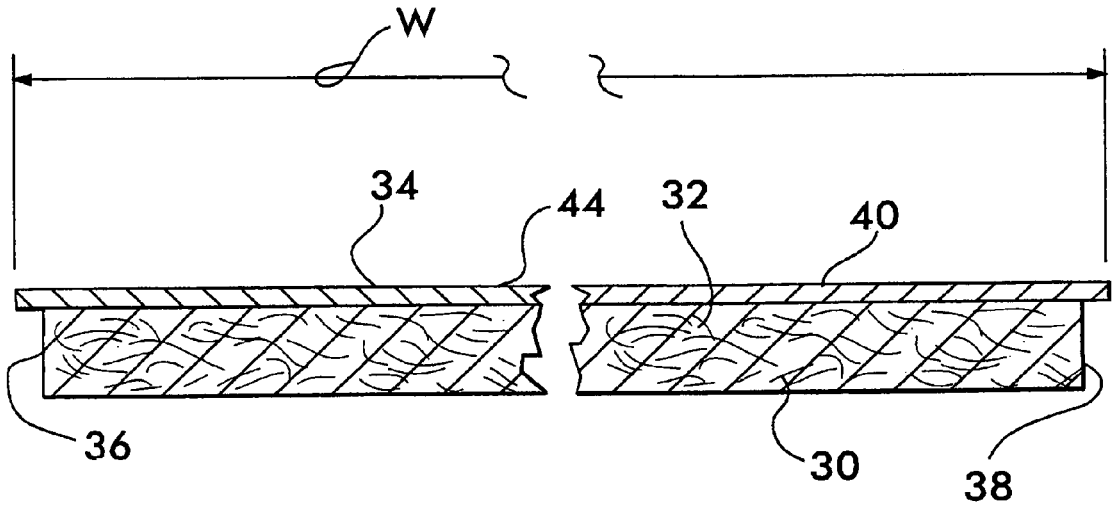
FIG.2

ROOF RIDGE VENT HAVING AN INTEGRAL COVERING AND METHOD OF INSTALLING A RIDGE VENT

CROSS-REFERENCE TO RELATED APPLICATIONS

This application claims the benefit under 35 USC §119(e) of U.S. Provisional Patent Application No. 60/637,972, filed Dec. 21, 2004.

BACKGROUND OF THE INVENTION

The present invention relates to a roof ridge vent that provides pathways for the circulation of air from an attic area underlying a roof structure to the ambient atmosphere above the roof structure.

It is useful, and in many locales a building code requirement, that the attic area of a building be provided with a means to permit air exchange. Such ventilation prevents undue heat buildup, which can render the living quarters of the building uncomfortable and impose unreasonable energy requirements for cooling. Proper ventilation of the attic area also tends to preserve the structural integrity of the roof and roof coverings. One method of venting the roof structure consists of applying a venting media over an elongate slot present along the ridge of a roof. These types of vents are known as ridge vents.

Examples of ridge vents are provided by U.S. Pat. Nos.: 5,960,595 issued to McCorsley et al.; U.S. Pat. No. 6,298,613 issued to Coulton et al.; U.S. Pat. No. 6,308,472 issued to Coulton et al.; U.S. Pat. No. 5,902,432 issued to Coulton et al.; U.S. Pat. No. 5,673,521 issued to Coulton et al.; and U.S. Pat. No. 4,942,699 issued to Spinelli. The above referenced patents are owned, or co-owned, by Benjamin Obdyke, Inc., the assignee of the present application.

Cap shingles or like exterior building materials are installed over a ridge vent after the ridge vent is secured to the roof ridge. The cap shingles provide a water resistant covering and are selected such that they provide the roof with a desired exterior finished appearance. Typically, cap shingles are selected to that they match the appearance (ie., color, texture, etc.) of the surrounding roofing shingles applied to the remaining sloped portions of the roof. Thus, the vented roof ridge structure blends into the surrounding sloped portions of the roof providing an aesthetically acceptable appearance.

U.S. Pat. Nos. 5,676,597 issued to Bettoli et al., U.S. Pat. No. 6,125,602 issued to Freiborg et al., and U.S. Pat. Nos. 6,418,692 B1 and 6,530,189 B2 issued to Freshwater et al. disclose composite ridge shingles and sectional ridge vents. The shingles are constructed, for instance, of conventional asphalt compositions, and the sectional vents are provided as a mat of fibers or a pattern of walls that form ventilation channels. Thus, the installation of each shingle also simultaneously accomplishes the installation of a portion of a ridge vent structure. A plurality of the composite shingles/sectional vents are installed in overlapping fashion along the length of the roof ridge to complete the installation of both the sectional ridge vent and ridge cap shingle installation.

While the roof ridge vents disclosed in the above referenced patents may function in an acceptable manner, there continues to be a need for alternatives with respect to the design, materials and manufacturing of roof ridge vent products. To this end, a desired vent should permit the construction of a vented roof ridge structure having an aesthetically-pleasing finish appearance and should permit improvements with respect to the ease of installation and time required to apply a roof ridge covering. The vents should permit a sufficient amount of ventilating air flow without compromising weather infiltration resistance and should be capable of being properly installed in a manner requiring labor skills possessed by the average roof installer. In addition, the vent should be capable of efficient manufacture from inexpensive materials and should be capable of efficient storage, shipping and handling.

BRIEF SUMMARY OF THE INVENTION

More specifically, the present invention provides a method of installing a ridge vent and water resistant outer covering on a roof ridge having an elongate open ventilation slot. The method includes the step of selecting a ridge vent having an integral water resistant outer covering that provides a desired external appearance. Thereafter, a continuous length of the roof ridge vent is secured on the roof ridge such that the continuous length completely overlies the elongate open ventilation slot. Thus, the single process step of securing the roof ridge vent simultaneously accomplishes the installation of a water resistant outer covering on the ridge. Thus, the use and separate installation of cap shingles are not required.

Preferably, the method includes the step of transporting the roof ridge vent with integral water resistant outer covering in the form of a spiral roll to the site of the roof. In addition, preferably the method includes the step of unrolling the spiral roll before or during the step of securing the vent to the roof ridge. Further, the vent and integral water resistant outer covering is flexed along a longitudinally-extending center section thereof during the step of securing the roof ridge vent so that the ridge vent and integral water resistant outer covering conform to the inverted-V shape of the roof ridge. The outer covering can be provided as a continuous strip of material or as a plurality of overlapping sections.

According to another aspect of the present invention, a roof ridge vent installation is providing that includes a roof covered with roofing shingles and having a ridge with an elongate open ventilation slot. An elongate, continuous ridge vent is secured to the roof overlying the ridge and completely overlying the open slot. The vent has a water resistant outer covering and a ventilation material that is integral with the outer covering and that extends underneath the outer covering. The ventilation material defines an opposed pair of longitudinally-extending side edges of the vent and is preferably made of an openwork material that provides multiple paths of ventilation from the open slot to the side edges of the vent. The water resistant outer covering has a top surface providing a desired external appearance.

Preferably, the water resistant outer covering is a thermoset single-ply roofing membrane, a thermoplastic single-ply roofing membrane, or a modified bitumen roofing membrane. Alternatively, the water resistant outer covering can be cap shingles or an asphalt material and have a texture that substantially matches the texture of the roofing shingles. The outer covering can be provided as a continuous strip of material or as a plurality of overlapping sections. An outer covering having a plurality of overlapping sections can be utilized to cover the heads of nails used to secure the vent to the roof.

According to yet a further concept of the present invention, a roof ridge vent is provided that includes an openwork ventilation material and a water resistant outer covering that extends over the ventilation material and that is integral therewith. The ventilation material and integral water resistant outer covering are rollable lengthwise into a spiral roll for storage and transport and can be unrolled for installation on a roof ridge. The covering can be, for instance, any of the materials discussed above.

BRIEF DESCRIPTION OF THE DRAWINGS

The foregoing and other objects, features and advantages of the present invention should become apparent from the following description when taken in conjunction with the accompanying drawings, in which:

FIG. 1 is a side elevational view of the vent according to the present invention in a spiral roll;

FIG. 2 is a cross-sectional of the vent along lines 2-2 in FIG. 1;

DETAILED DESCRIPTION OF THE INVENTION

Figure 3:
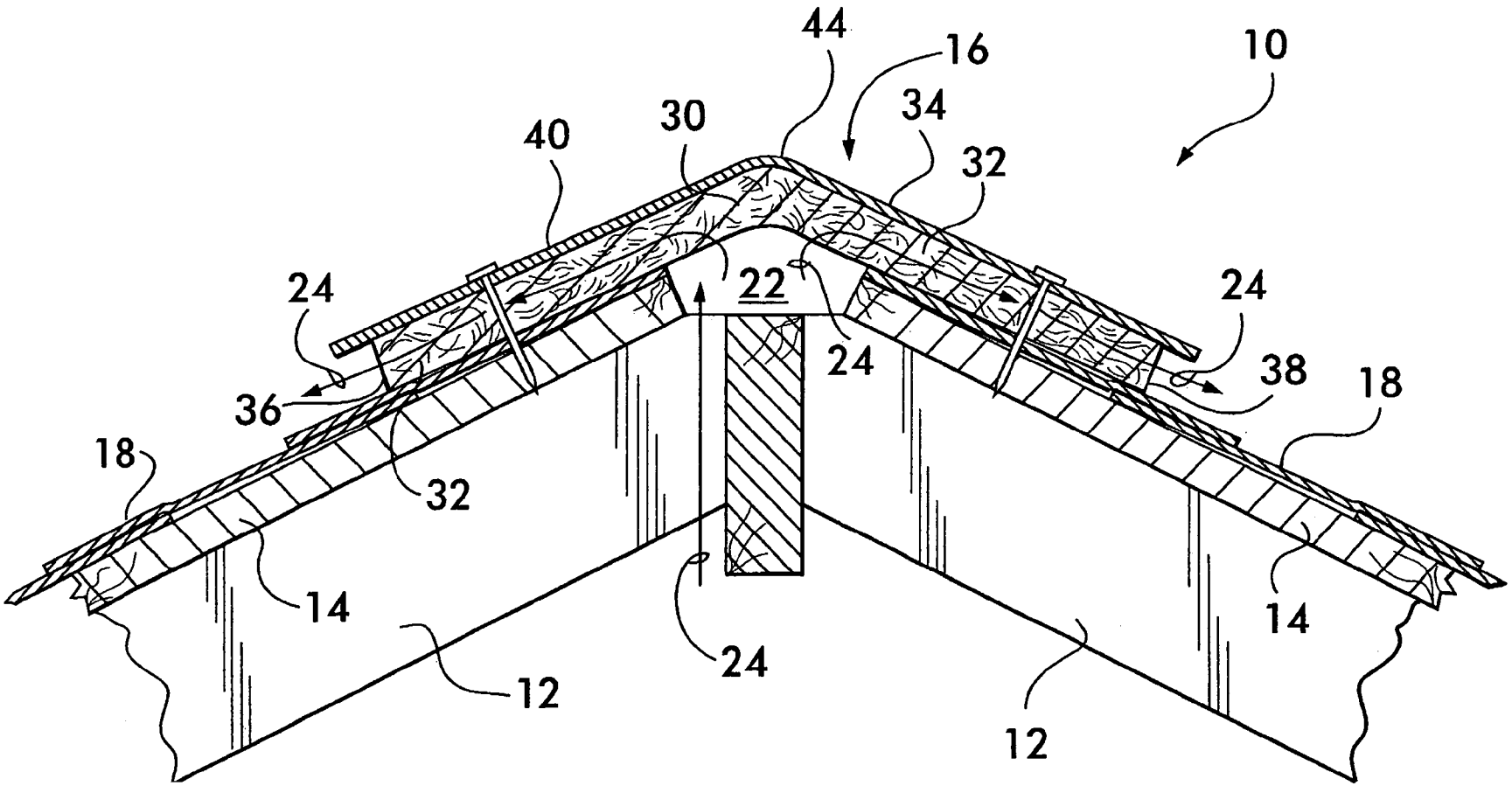
FIG. 3 is an elevational cross-sectional view of the roof ridge vent installed on a roof ridge according to the present invention.

Referring now to the drawings, FIG. 3 illustrates a roof 10 having a typical construction which utilizes a ridge vent. The roof 10 is constructed from a plurality of rafters 12 supported at their lower ends, for instance, by front and rear walls (not shown) of the building. A roof deck 14 is typically constructed of plywood, or other suitable panels, to provide an outer sheathing of the building. The roof deck 14 is secured to the rafters 12, extends to the end walls, and forms a ridge, or peak, 16 therebetween. Shingles 18 or like exterior building materials are secured to the roof deck 14 to finish sloping portions of the roof 10 in accordance with conventional construction practices. An open slot 22 is provided along the length of the roof ridge 16 to provide a passageway for air to vent from the underlying attic area to the ambient atmosphere as illustrated by arrows 24 in FIG. 3.

The shingles 18 may be conventional asphalt shingles or the like. The shingles are typically of a predetermined common color, or colors, and texture to provide the roof with an aesthetically pleasing exterior appearance. Although not illustrated, architectural shingles or other exterior building materials of a predetermined color and texture can also be utilized to finish sloping portions of a roof.

A roof ridge vent 30 according to the present invention includes a ventilation component 32 and an outer waterproof covering 34. The ventilation component 32 engages the roof ridge 16 and supports the covering 34 a spaced distance above the underlying roof surface 16 and slot 22. In addition, the ventilation component 32 defines multiple ventilation flow paths 24 from the open slot 22 to side edge openings, 36 and 38, of the vent 30. The covering 34 provides the finished exterior surface of the vented roof ridge structure and provides a waterproof cover over the slot 22 to prevent the entry of rain, snow, and the like. The composite vent 30 eliminates the need to separately apply cap shingles or like exterior building materials on the vent 30 after installation thereof. Rather, the vent 30 has an upper surface 40 provided by the outer waterproof covering 34 that provides the function of cap shingles.

The ventilation component 32 can be provided in various forms. For example, an openwork material can be utilized as the ventilation component 32. The openwork material can be a single mat of fibers of a width sufficient to span the open slot 22 as illustrated in FIGS. 2 and 3 or can be provided as a pair of spaced-apart mats located on opposite sides of the open slot 22. As an alternative to a mat of fibers, a layer of fibers or screen formed with three dimensional cusps or like supports can be utilized. Alternatively, a corrugated material or a sheet of thermoplastic material formed with a pattern of cusps or the like can be utilized as an openwork material. The ventilation component 32 can also be provided by an arrangement of vertically-extending walls, or baffles that define open passageways therebetween. Yet another alternative is to utilize walls made of an air permeable material such as a fabric, screen or the like.

According to some embodiments of the present invention, the outer covering 34 is as an elongate, continuous waterproof membrane that is bonded directly to the ventilation component 32 or to an intermediate sheet material (not shown) extending between the outer covering 34 and ventilation component 32. The intermediate sheet can be used as a means of securing the covering 34 and component 34 together. The covering 34 can be a thermoset single-ply roofing membrane such as a membrane made of EPDM (ethylene propylene durometer) or EPR (ethylene propylene rubber). Alternatively, the covering 34 can be a thermoplastic single-ply roofing membrane such as a membrane made of thermoplastic polyolefins (TPO) or polyvinyl chloride (PVC). The covering 34 can also be provided as a modified bitumen roofing membrane or like waterproof material. Yet another alternative is to utilize cap shingles, an asphalt material, or a composite material including asphalt laminated to the ventilation component 32 or intermediate sheet material.

The covering 34 is bonded directly or indirectly to the ventilation component 32 such that the covering 34 and ventilation component 32 form an integral vent 30. The covering 34 and ventilation component 32 can be adhesively secured to each other or to opposite sides of an intermediate material. Alternatively, the covering 34 and ventilation component 32 can be secured together utilizing thermal bonding techniques.

Figure 4:
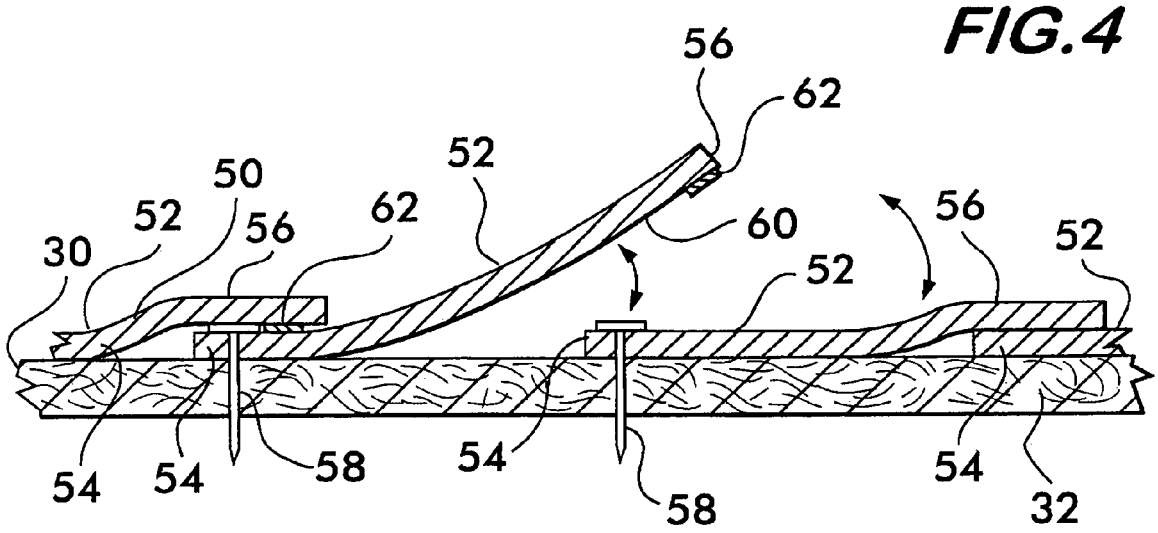
FIG. 4 is side elevational view of an alternate embodiment of a vent according to the present invention.

An alternate embodiment of an outer covering 50 is illustrated in FIG. 4. The outer covering 50 includes a plurality of separate overlapping sections 52. Preferably, one end 54 of each section 52 is bonded to the ventilation component 32 or to an intermediate sheet (not shown) and the other end 56 can be deflected upwardly from the ventilation component 32. Thus, during installation, the end 56 can be deflected upwardly, a nail 58 can be driven through the vent to secure the vent to an underlying roof, and thereafter, the end 56 can be returned to its original position overlying the head of the nail 58. The underside 60 of the end 56 can be provided with a strip of adhesive 62 or the like so that end 56 can be secured to an underlying section 52 after installation of nail 58. The strip of adhesive 62 can initially be covered with a release sheet (not shown).

As best illustrated in FIG. 1, the vent 30 is rollable into a spiral roll 42 during or after manufacture, is stored and transported in roll-form, and is unrolled during or before installation on a roof ridge. By way of example, and not by way of limitation, the above described ridge vent 30 can be made in indefinite, continuous lengths having a width "W" of about 7 to about 12 inches and a height "H" of about 0.5 to about 1 inch. Of course, larger or smaller dimensions can also be utilized as desired.

The vent 30 can also be provided with additional protection against weather and/or insect infiltration, if desired. A filter material (not shown) such as a fabric, a non-woven fabric, a non-wicking hydrophobic fabric, a mat of filaments, an air permeable foam plastic, a screen, or a material having a multiplicity of closely spaced openings permitting the flow of air therethrough can extend lengthwise underneath the cover 34.

With respect to the installation process of the vent 30, a vent 30 that provides a desired exterior finish can be selected. The outer covering 34, such as any of the above discussed membranes, can be provided in shades of black or grey or in various other colors and/or textures, as desired. Thus, a ridge vent 30 can be selected based on its exterior appearance. As one example, the coloring and/or texture of outer covering can be selected such that it substantially blends with or matches the coloring and/or texture of roofing shingles 18 or the like that are, or will be applied, on sloping portions of the roof 10 adjacent the roof ridge 16.

Preferably, the vent 30 is provided to the building site in a spiral roll 42, is unrolled lengthwise, and is aligned on the roof ridge 16. An elongate, continuous length of the vent 30 is then secured to the underlying roof surface 16 with nails, staples, adhesives, or the like, such that the vent 30 completely overlies the open elongate ventilation slot 22 formed in the roof ridge 16. As discussed above, the covering can include a plurality of sections having ends which can be used to cover nails driven through the vent. (See FIG. 4.) The roof ridge vent 30, including the integral water resistant outer covering 34, is flexible at least along a longitudinally-extending center section 44 thereof so that the roof ridge vent 30 and integral water resistant outer covering 34 conform to an inverted-V shape of the roof ridge 16. Since the outer covering 34 is integral with the ventilation component 32 of the vent 30, installation of the outer covering 34 is accomplished simultaneous with installation of the ventilation component 32 thereby eliminating the need to subsequently install cap shingles or the like.

The above-described roof ridge vent according to the present invention provide a uniquely constructed roll-form vent that is easy to install, is inexpensive to manufacture, provides a desired amount of air flow therethrough, and prevents weather infiltration. In addition, the vent and exterior covering can be installed simultaneously in a single-step process.

While preferred roof ridge vents, roof ridge vent installations, and installation methods have been described in detail, various modifications, alterations, and changes may be made without departing from the spirit and scope of the vent and installations according to the present invention as defined in the appended claims.

The invention claimed is:

1. A method of installing a ridge vent on a roof ridge, comprising the steps of:

bonding a plurality of separate cap shingles in an overlapping configuration to a separate, elongate, continuous openwork roof ridge vent to provide the vent with an external surface that provides a desired appearance;

after said bonding step, rolling the plurality of cap shingles and the elongate, continuous openwork roof ridge vent together into a spiral roll and transporting said roof ridge vent and plurality of cap shingles in the form of said spiral roll to the roof ridge;

after said bonding, rolling, and transporting steps, simultaneously applying a continuous length of said vent and said cap shingles on the roof ridge such that said continuous length completely overlies an elongate open ventilation slot; and before or during said applying step, unrolling said spiral roll;

said applying step providing a one step process for installing both said vent and said cap shingles to the roof ridge.

2. A method according to claim 1, wherein, during said applying step, said roof ridge vent and said cap shingles are simultaneously flexed along a longitudinally-extending center section thereof so that said roof ridge vent and cap shingles conform to an inverted-V shape of the roof ridge.

3. A method according to claim 2, wherein said cap shingles are made of a material selected from a group consisting of a thermoset single-ply roofing membrane, a thermoplastic single-ply roofing membrane, and a modified bitumen roofing membrane.

4. A method according to claim 2, wherein said cap shingles are made of an asphalt material laminated to said ridge vent,

5. A method according to claim 2, wherein said applying step includes lifting up one end of a section of one of said overlapping cap shingles, securing the vent to the roof with a nail, and releasing said one end of said section to cover said nail.

6. A method according to claim 2, further comprising a step of selecting a roof ridge vent having said integral cap shingles that are of a color that blends with a color of adjacent roofing shingles.

7. A method according to claim 6, wherein said selecting step includes selecting a roof ridge vent having said integral cap shingles that are of a texture that substantially matches a texture of adjacent roofing shingles.

8. A roof ridge vent installation, comprising:

a roof having a ridge with an elongate open ventilation slot; and an elongate, continuous, one-piece rollable ridge vent secured to said roof overlying said ridge and completely overlying said open slot;

said vent comprising a plurality of separate cap shingles pre-bonded in an overlapping configuration to a continuous ventilation component extending underneath said cap shingles to support said cap shingles a spaced distance above said ventilation slot, said ventilation component being a continuous, elongate mat of fibers providing multiple paths of ventilation therethrough from said open slot to longitudinally-extending side edges of said vent.

9. A roof ridge vent installation according to claim 8, wherein said cap shingles are made of a material selected from a group consisting of a thermoset single-ply roofing membrane, a thermoplastic single-ply roofing membrane, and a modified bitumen roofing membrane.

10. A roof ridge vent installation according to claim 8, wherein said cap shingles are made of an asphalt material.

11. A roof ridge vent installation according to claim 8, wherein said cap shingles have a top surface that blends wit roofing shingles on sloping portions of said roof.

12. A roof ridge vent installation according to claim 11, wherein said top surface substantially matches a color and texture of said rooting shingles.

13. A roof ridge vent, comprising:

an elongate, continuous openwork ventilation component defining multiple flow paths of ventilation through the vent; and a plurality of separate1y manufactured cap shingles bonded to said ventilation component in an overlapping configuration;

said openwork ventilation component being a mat of fibers spacing said cap shingles from an underside of the vent; and said ventilation component and cap shingles being rollable together lengthwise into a spiral roll for storage and transport and being unrollable for installation on a roof ridge.

14. A roof ridge vent according to claim 13, wherein said cap shingles are made of a thermoset or thermoplastic single-ply roofing membrane or a modified bitumen roofing membrane.

15. A roof ridge vent according to claim 14, wherein said cap shingles are made of EPDM, TPO or PVC.

16. A roof ridge vent according to claim 13, wherein said cap shingles are made of an asphalt material.

17. A roof ridge vent according to claim 13, wherein said vent has a longitudinally-extending center section that is bendable permitting said vent to conform to an inverted-V shape of a roof ridge.

* * * * *